United States Patent [19]

Boulanger

[11] Patent Number: 4,917,414

[45] Date of Patent: Apr. 17, 1990

[54] INTERLOCK ARRANGEMENT FOR AN APPLIANCE DOOR AND AN INTERLOCK UNIT THEREFOR

[75] Inventor: Henry J. Boulanger, Nicholasville, Ky.

[73] Assignee: Texas Instruments Incorporated, Dallas, Tex.

[21] Appl. No.: 289,342

[22] Filed: Dec. 23, 1988

[51] Int. Cl.[4] ..... E05C 5/02

[52] U.S. Cl. ..... 292/98; 292/113; 292/DIG. 65; 292/DIG. 66; 292/DIG. 69

[58] Field of Search ..... 292/113, 106, DIG. 65, 292/DIG. 66, DIG. 69, 98; 219/398, 412; 337/319

[56] References Cited

U.S. PATENT DOCUMENTS

| | | | |
|---|---|---|---|
| 3,325,200 | 6/1967 | Fowler | 292/113 |
| 3,815,942 | 6/1974 | White | 292/113 |
| 4,593,945 | 6/1986 | Arute et al. | 292/DIG. 69 X |

*Primary Examiner*—Richard E. Moore

*Attorney, Agent, or Firm*—James P. McAndrews; John A. Haug; Melvin Sharp

[57] ABSTRACT

A door interlock arrangement for an appliance such as a self-cleaning electric oven has an operating lever manually movable in a limited arc to move a door bolt into and out of door latching position and provide further motion to close the door very securely, and has a lock arranged in a novel cooperative relationship with an electrical interlock unit to permit certain appliance operations only when the door is latched and to permit opening of the door after the end of those appliance operations only when a selected appliance zone has cooled to a safe temperature.

7 Claims, 4 Drawing Sheets

INTERLOCK ARRANGEMENT FOR AN APPLIANCE DOOR AND AN INTERLOCK UNIT THEREFOR

BACKGROUND OF THE INVENTION

The field of the invention is that of electrical appliances and the invention relates more particularly to a door interlock arrangement for an appliance such as a self-cleaning oven or a dishwasher or the like.

In a known and widely used door latching system for certain appliances such as self-cleaning electric ovens and dishwashers, an operating lever conveniently requires only a limited arc of pivotal movement for closing an appliance door but is arranged to move a door bolt with much greater angular velocity and to draw the bolt firmly into place to provide very secure latching of the door. Such systems also incorporate interlock means intended to prevent opening of the appliance door after the end of at least some appliance operations such as self-cleaning of an oven until the temperature in the oven has cooled to a safe level. Such systems also typically include redundant controls for operating at least some appliance components to avoid inadvertent operation of the appliance in self-cleaning modes or the like. It would be desirable if such door interlocking and redundancy functions could be accomplished in a more convenient and economical manner without interfering with provision of the desired secure door latching characteristics.

SUMMARY OF THE INVENTION

It is an object of the invention to provide a novel and improved door interlock arrangement for an appliance door; to provide such an arrangement which permits very secure and reliable closing of the door; to provide such an arrangement which prevents operation of the appliance until the door is closed and prevents opening of the door during appliance operation and after appliance operation has been discontinued until temperature in a selected zone of the appliance has assuredly cooled to a safe temperature; to provide a novel and improved interlock unit for use in such an arrangement; to provide such a unit compactly incorporating switch means for performing redundancy control functions in such an interlock unit; and to provide such a door interlock arrangement which is compact, economical and reliable.

Briefly described, the door interlock arrangement of the invention comprises a support, a manual operating lever pivotally mounted on the support, and a door bolt pivotally mounted on the support to be responsive to operating lever movement for moving between a latching position in which an appliance door is securely closed and an unlatching position permitting the door to be open. Preferably the operating lever moves through a limited arc at one angular velocity to move the door bolt with relatively greater angular velocity to provide convenient, firm and very secure door latching during certain appliance operations such as self-cleaning of an oven or the like.

A cam is provided on the operating lever and a radial slot is disposed at a circumferential location on the lever. A lock is pivotally mounted on the support for movement in a plane between latching and unlatching positions of the lock. The lock has a cam follower engaged by the operating lever cam as the lever moves to its latching position for pivoting the lock to its latching position and has a detent which moves into the lever slot as the lock pivots to lock the lever in its latching position. Preferably the lock pivots on an axis which is tangentially disposed relative to the operating lever slot when the lever is in its latching position.

An interlock unit is mounted on the support and has an interposer member which is normally disposed under the plane of the lock movement to permit free lock movement before the appliance is operated. The unit has first movable and complementary contacts engageable for operating the appliance, has an electrical resistance heater such as a self-regulating heater to be energized when appliance operation is to be initiated, and has means thermally responsive to the heater and to a temperature in a selected appliance zone to move the interposer member into the plane of lock movement only when the lock is in its latching position, to engage the first movable and complementary contacts of the unit to operate the appliance only while the lock is in its latching position, and to intercept the lock when the member is in that plane to prevent movement of the lock from its latching position to is unlatching position. That is, the thermally responsive means is adapted to initiate appliance operation after locking of the door and closing of the appliance control switch. It is then adapted to release the lock to permit the lock to move from its latching position to its unlatching position only after appliance operation is discontinued and only after the selected appliance zone has cooled to a safe temperature. The lock is preferably positioned so the lock blocks movement of the interposer member into the plane of lock movement when the lock is in its unlatching position and concomitantly prevents engagement of the first movable and complementary contacts, thereby preventing appliance operation when the lock is unlatched. Preferably the thermally responsive means includes a thermostat metal element which is movable between original and inverted dished configurations with snap action at selected operating and reset temperatures and which cooperates with an elongated metal contact arm strip of substantial length to provide substantial movement of the interposer member to move it clearly into and out of the plane of lock movement when desired and for providing sharp engagement and disengagement of the first movable and complementary contacts of the unit to start and stop appliance operation while avoiding generation of significant r.f. interference by the unit. Preferably the interlock unit compactly accommodates additional movable and complementary contacts at one side of the strip to be engaged for performing redundancy control functions in cooperation with the first interlock unit contacts and arranges operator button means to cooperate with lock movement for coordinating the redundancy functions with door interlocking. In one preferred embodiment, movement of the lock to its latching position also moves the operator button to engage a pair of the additional movable contacts to selectively energize the interlock heater only when the door is locked.

In that arrangement, operation of the appliance is not initiated until the door is securely locked. If an appliance control switch is closed before the door is locked, the lock is positioned in its unlatching position to block entry of the interposer member into the plane of lock movement and concomitantly prevents energizing of the interlock heater and engagement of the first unit contacts to prevent appliance operation. If the operating lever is then manually moved for closing the door and moves the lock to its latching position, the operator button engages a pair of the additional interlock contacts for energizing the heater. The thermally responsive means then move so the interposer member is permitted to move into the noted plane and the first unit contacts are engaged for initiating appliance operation. It an attempt is made to open the door while the appliance is operating, the interposer member intercepts and prevents movement of the lock in the plane of lock movement for preventing door opening. Where the lock axis is tangential to the location of the slot on the operating lever, the lock detent receives very little turning force from the attempted movement of the operating level so the lock easily and reliably retains the door closed. If appliance operation is then discontinued by timer operation, by opening of an appliance control switch, or by power failure or the like, the heater is deenergized and the interlock unit continues to retain the door closed until the thermally responsive means of the unit cools to a reset temperature as the temperature in the selected appliance zone cools to a safe temperature. The interposer member then moves from the plane of lock movement for permitting opening of the appliance door.

DESCRIPTION OF THE DRAWINGS

Other objects, advantages and details of the novel and improved interlock arrangement and unit of this invention appear in the following detailed description of preferred embodiments of the invention, the description referring to the drawings in which.

DESCRIPTION OF THE PREFERRED EMBODIMENT

Figure 1:
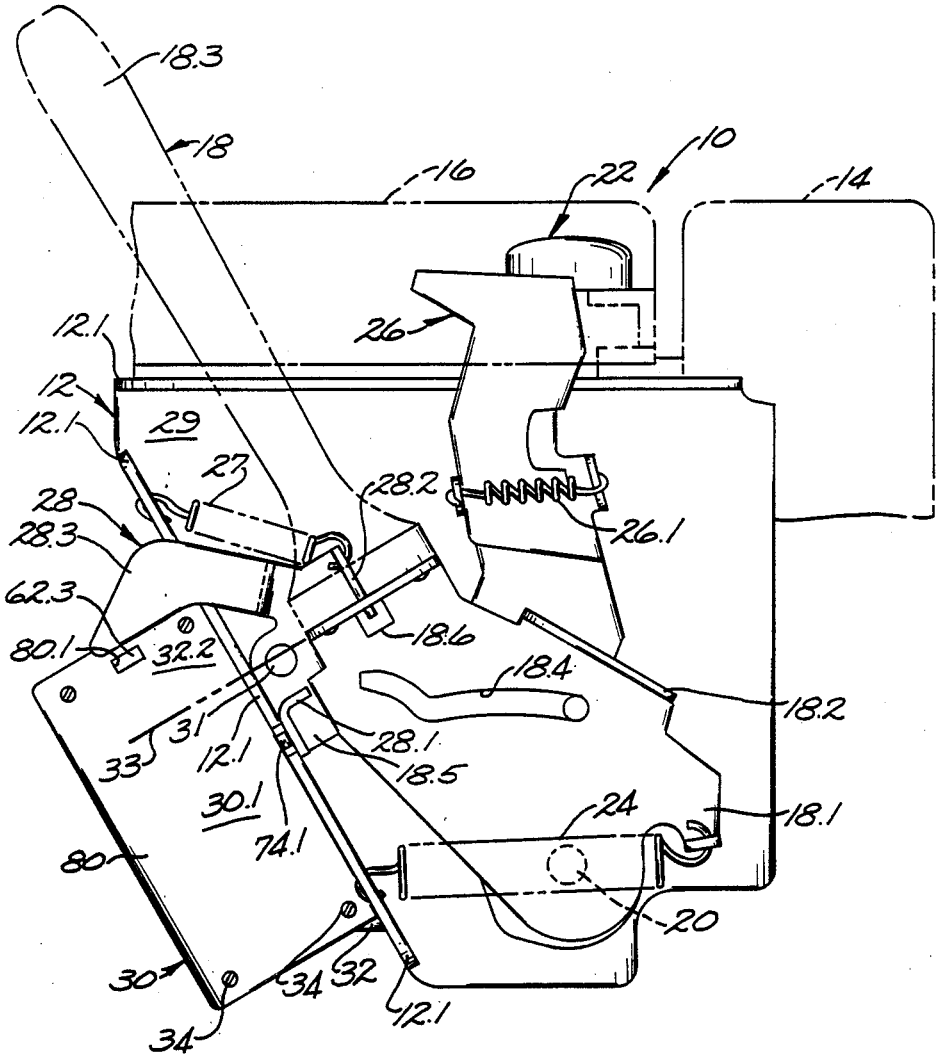
FIG. 1 is a plan view of the door interlock system of the invention illustrating cooperation of an interlock unit with a door latch to retain an appliance door in closed position during appliance operation.
Figure 2:
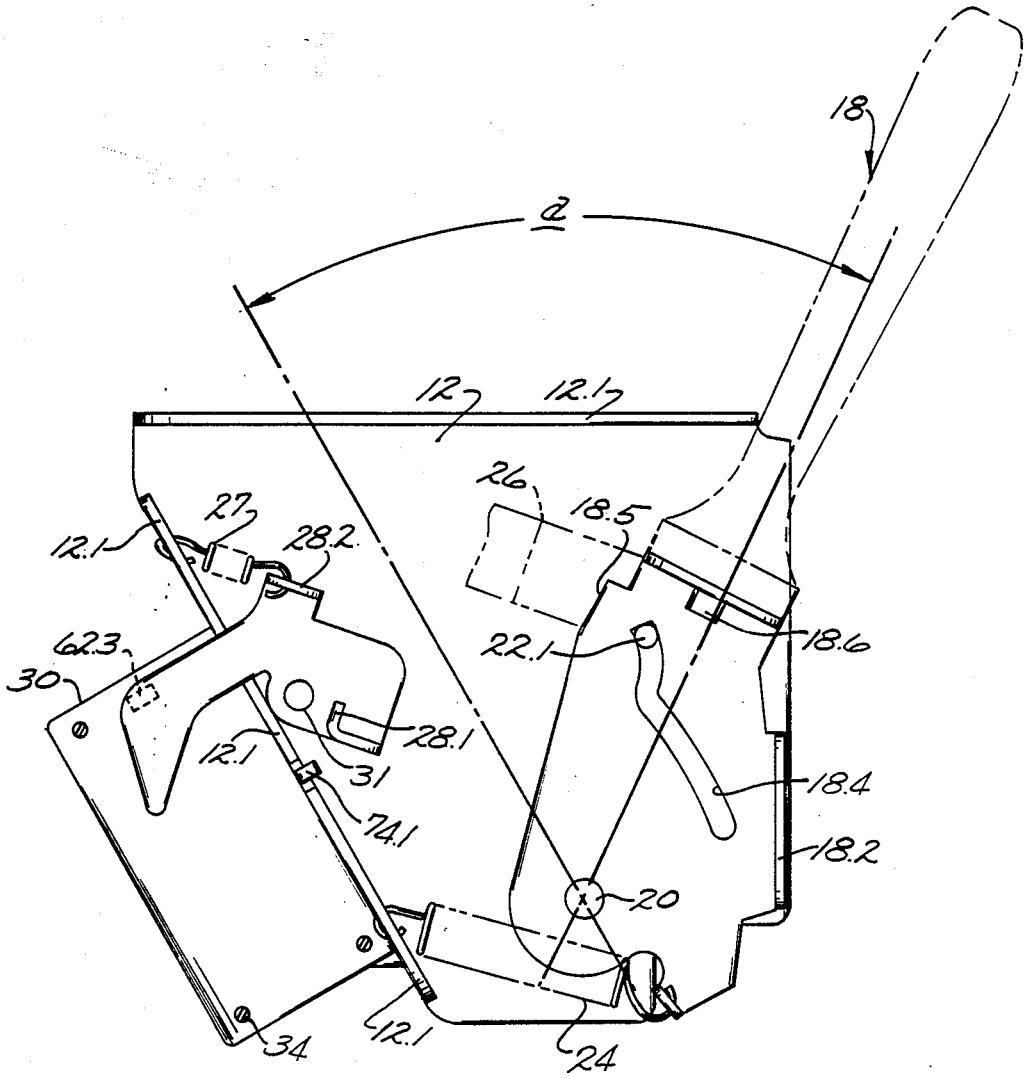
FIG. 2 is a plan view of the arrangement of FIG. 1 with some components omitted illustrating the interlock arrangement in an alternate position permitting movement of the appliance door to open position with a delay after end of appliance operation.

Referring to the drawings, 10 in FIGS. 1 and 2 indicates the novel interlock arrangement for an appliance door as provided by this invention. The arrangement includes a support such as a sheet metal plate 12 or the like preferably having one or more stiffening ribs or flanges 12.1. The support is adapted to be mounted inside a selected zone of an appliance such as the oven of a self-cleaning electrically heated oven 14 adjacent an opening for an appliance door 16. An operating lever 18 is pivotally mounted on the support for movement around an axis 20 between a lever latching position shown in FIG. 1 and an unlatching position as shown in FIG. 2. Preferably the lever is arranged to move through a relatively limited arc a (see FIG. 2). Preferably the lever comprises a sheet metal plate portion 18.1 having stiffening flanges 18.2 and has a shaped handle portion 18.3 secured to one of those flanges by screws or other conventional attaching means.

A door bolt 22 is also pivotally mounted on the support for movement around a corresponding axis (not shown) and is operatively connected to the operating lever, by engagement of the operating lever cam surface 18.4 with the door bolt cam follower 2.1 against the bias of the spring 24 for example, so that lever movement moves the door bolt, preferably with a relatively greater angular velocity than the lever, between a latching position of the door bolt wherein the bolt holds the door very securely closed as shown in FIG. 1 and an unlatching position of the door bolt as shown in FIG. 2 permitting opening of the door. Preferably the door bolt arrangement includes a feeler means 26 pivotally mounted with the bolt and biased by the spring 26.1 which is adapted to engage the door and be moved clear of a hook end 22.2 of the door bolt to permit full movement of the door bolt to its latching position only when the door is properly positioned to be securely latched by movement of the door bolt to its latching position. As components of the arrangement 10 as thus far described are well known as described in U.S. Pat. Nos. 3,325,200 and 3,815,942 and as various similar support, lever and bolt components are also adapted for use within the scope of this invention, the general structure of those components is not further described herein and it will be understood that the interlock arrangement 10 includes a support, an operating lever pivotally mounted on the support for movement between latching and unlatching positions of the lever, and a door bolt pivotally mounted on the support between corresponding latching and unlatching positions of the door bolt in response to lever movement. In accordance with this invention, the lever also has a cam portion 18.5, preferably located at a lateral edge of the lever for example, and has a radial slot 18.6 which is disposed at a circumferential location on the lever. That is, the slot is disposed so that, as it moves through an arc during pivotal lever movement, the slot is accessible from outside the circumference of that arc. Preferably, where the operating lever has the structure shown, the slot 18.6 extends into the plate 18.1 and into one of the flanges 18.2 as shown in FIG. 1.

A lock 28 is also pivotally mounted on the support for movement in a plane (indicated at 29 in FIG. 1 and in FIG. 4) generally parallel to the support plate 12 between a latching position of the lock as shown in FIG. 1 and an unlatching lock position as shown in FIG. 2. The lock is biased to the position shown in FIG. 2 by the spring 27. Preferably the lock pivots on an axis 31 which is tangentially disposed relative to the slot 18.6 when the lever is in its latching position as is indicated by reference line 33 in FIG. 1. The lock has a cam follower 28.1 to be engaged by the lever cam 18.5 to pivot the lock against the bias of spring 27 during movement of the lever to latching position and has a detent 28.2 which is moved into the lever slot 18.6 as the lock and lever are pivoted to their latching positions for locking the lever in its latching position. Preferably the lock is formed of sheet metal having one end mounting the cam follower 28.1 at one level in the noted plane 29 in upstanding relation to that end of the lock to be easily and reliably engaged by the operating lever cam 18.5, has the detent 28.2 also arranged in upstanding relation to the lock to be easily and reliably received in the slot 18.6, and has an opposite end 28.3 disposed at another level in the plane 29 as indicated in FIG. 1.

An interlock unit 30 is also mounted on the support, preferably by brackets 32 and screws 34 or other conventional means and preferably adjacent a stiffening support flange 12.1 for securely positioning the unit adjacent to the plane 29 so that at least one part 30.1 of the unit is adjacent an edge of the plane, and at least one part 30.2 of the unit underlies at least part 28.3 of the lock when the lock is in its unlatching position. See FIG. 2.

Figure 3:
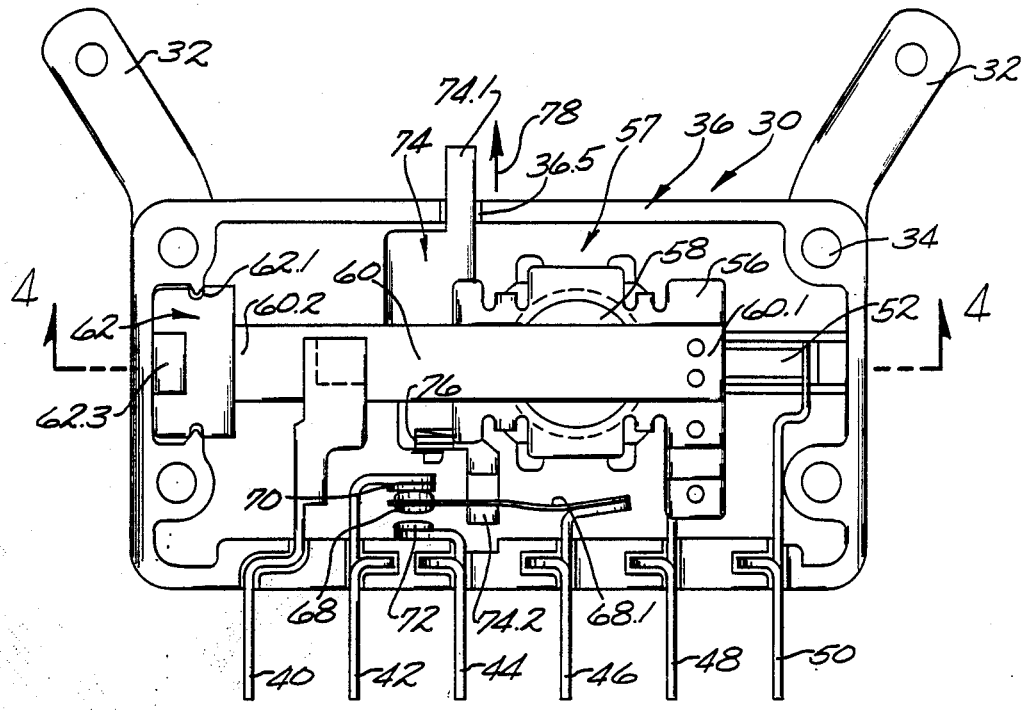
FIG. 3 is a plan view of an interlock unit of the arrangement of FIG. 1 to greatly enlarged scale with a unit cover removed.
Figure 4:
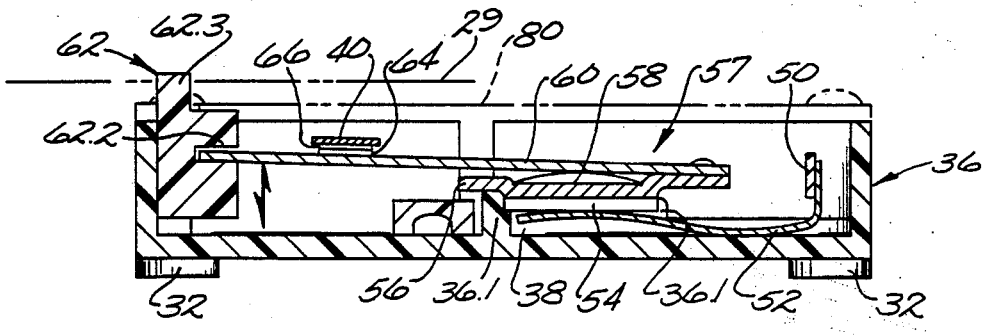
FIG. 4 is a partial section view along line 4—4 of FIG. 3.

As best shown in FIGS. 3 and 4, the interlock unit 30 includes a base preferably molded in an elongated, open, rectangular box configuration from a strong stiff electrical insulating material such as a glass reinforced polyphenylene sulfide. Preferably an integral wall 36.1 upstands from the base to define a recess 38. A plurality of electrically conductive terminals 40, 42, 44, 46, 48, and 50 are blanked from brass or the like and provided with bent tongue or intermediate portions or the like to be captured in correspondingly shaped terminal openings in an integral base side wall 36.2 (see FIG. 3) to extend through that wall. Terminal 50 is electrically connected to a generally L-shaped conductive spring 52 which extends at one end into the recess 38 and an electrical resistance heater 54 of a ceramic material or the like of positive temperature coefficient of resistivity is disposed in the recess with one side of the heater body electrically connected to the spring. Another terminal 48 is electrically connected to a generally flat conductor 56 disposed over the recess and electrically connected to an opposite side of the heater body. The heater material is preferably selected to self-regulate at a selected temperature when the heater is electrically energized between the conductors 52 and 56.

A thermally responsive means 57 is also incorporated in the unit 30 in heat-transfer relation to the heater 54. Preferably for example a thermostat metal disc element 58 of a generally conventional type adapted to move between original and inverted dished configurations with snap action when heated to respective operating or reset temperatures is disposed on the conductive 56 in thermally conducting relation to the heater 54 and an electrically conductive and preferably stiffly resilient metal strip 60 is secured at one end 60.1 in electrically conductor relation to the flat conductor 56 and extends over the disc 58 and along a length of the base 36 to dispose an opposite end 60.2 of the strip at a relatively greater distance from the disc. As interposer member 62 preferably of a strong material such as the base material is slidably mounted at one end of the base, as in guide grooves 62.1, to receive the distal end 60.2 of the metal strip in a member groove 62.2 (see FIG. 4) so that snap acting movement of the disc 58 in response to temperature change permits the interposer member 62 to slide up and down in the base to raise and lower the tip 62.3 of the member. A first movable contact 64 is carried on the metal strip near the strip end 60.2 and the terminal 40 mounts a first complementary contact 66 over the strip to be normally spaced from the contact 64 but to be engaged by the movable contact when movement of the thermally response means 57 moves the strip 60 and raises the interposer member as noted above.

In a preferred embodiment of the invention, the terminal 46 mounts an additional movable contact 68, preferably on a resilient conductive spring arm 68.1, and the terminals 42 and 44 mount respective additional complementary contacts 70 and 72. Preferably those additional contacts are compactly accommodated in the unit along one side of the metal strip and preferably the contact arm 68.1 biases contact 68 to engage contact 72. An operator button 74 is compactly mounted on the base for slidable movement under the metal strip 60 and is biased by spring means 76 or the like to normally extend one end 74.1 of the operator from the interlock unit through an opening 36.5 in a side wall of the base at an opposite side of the metal strip. The operator has a hook end 74.2 or the like engaging the contact arm 68.1 and the spring 76 is normally adapted to overcome the bias of the arm 68.1 to engage contact 68 with contact 70 when the operator extends from the base opening 36.5. However depression of the operator as indicated by the arrow 78 in FIG. 3 is adapted to move the operator for permitting contact arm 68.1 to engage contact 68 with contact 72 in response to the contact arm bias.

Preferably a cover 80 is secured to the base for closing the box-like base configuration, the cover having an opening 80.1 for permitting the interposer member tip 62.3 to extend from the opening.

The interlock unit 30 is mounted on the support 12 so the tip 62.3 of the interposer member is normally disposed under the plane 29 of movement of the lock 28 and permits lock movement in that plane when the appliance is not being operated. The lock is located relative to the unit so that, when the lock is in its unlatching position as shown in FIG. 2, it intercepts and blocks movement of the member tip 62.3 into the plane 29 and concomitantly prevents engagement of the first unit contacts for operating the appliance. The lock is also located so that when the lock is its latching position as shown in FIG. 1, the interposer member is adapted to be move into the plane of lock movement to intercept and prevent movement of the lock from its latching position as shown in FIG. 1 to its unlatching position. Further, when the lock is in its latching position, the cam follower 28.1 of the lock is also moved against the operator 74 of the interlock unit for moving the contact 68 out of engagement with contact 70 and into engagement with contact 72.

Figure 5:
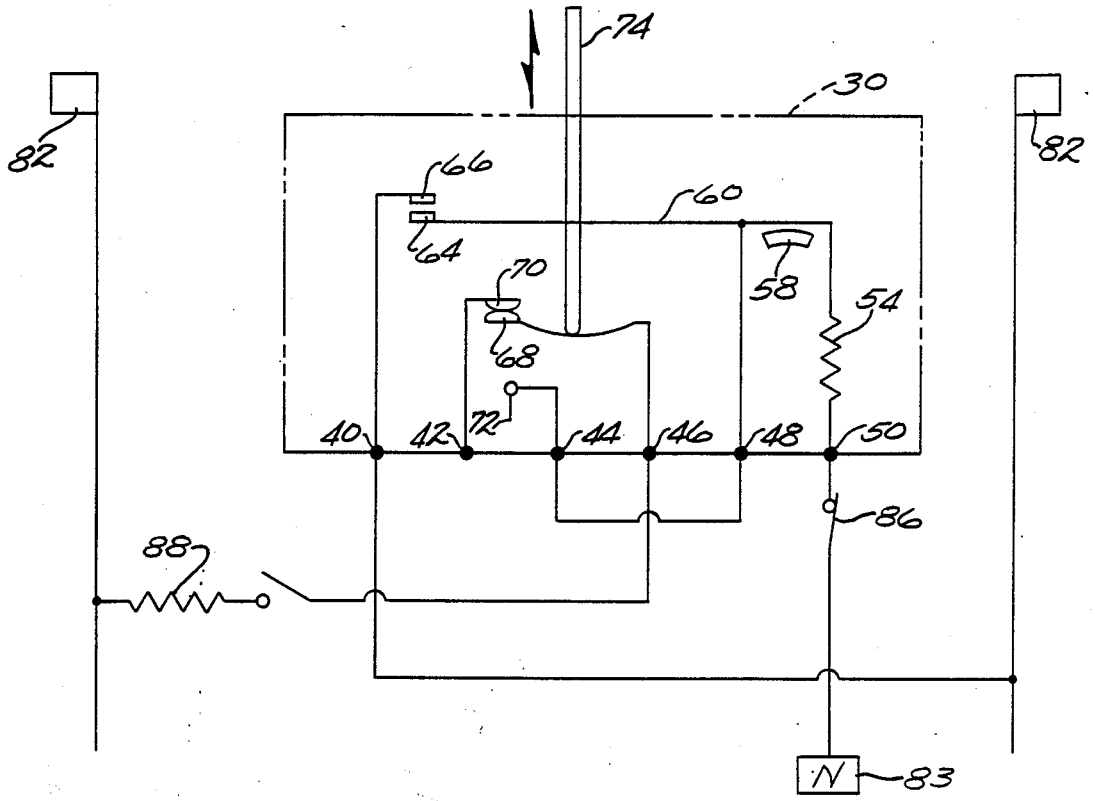
FIG. 5 is a schematic view illustrating operation of the door interlock arrangement for regulating appliance door opening.

In one interlock arrangement of the invention for example, terminal 50 is connected to a line terminal 82 of a 240 volt power supply for an electrical appliance such as a self-cleaning electrical oven terminal 46 is connected to the other line terminal 84 through an appliance thermostat 87 and an appliance load such as a heater 88; terminal 50 is connected to the neutral terminal 83 of the power source through an appliance control switch 86; and terminals 44 and 48 are interconnected by a jumper 85. Terminal 42 is adapted to be connected to another appliance component (not shown) as may be desired. When the lock 28 is in its unlatching position, contacts 64, 66 are disengaged as shown in FIG. 5 while contact 68 is connected to contact 70 but spaced from contact 72. In that arrangement, closing of the appliance control switch 86 is ineffective for energizing the load 88 or the interlock heater 54 as shown. However, if the operating lever is moved for locking the appliance door and moving the lock 28 to its latching position the operator button 74 is moved by the operating lever for engaging contact 68 with contact 72 so that the heater 54 is energized at 120 volts, the relatively high resistance of the heater 54 preventing substantial generation of heat by the load 88. The disc 58 is then actuated in response to heater 54 to engage contacts 64, 66 for energizing the load 88 at 240 volts for operating the appliance. At the same time, the interposer tip 62.3 enters the plane 29 and retains the lock 28 in its latching position.

If the operating lever is moved to open the appliance door when appliance operation is continuing, the interposer member tip prevents movement of the lock 28 and retains the door in closed position. Such attempted opening of the door applies little turning force to the lock so the interlock unit securely holds the door in closed position. After operation of the appliance is subsequently discontinued by timer operation, by opening of the switch 86 or by a power failure or the like so that the load 88 no longer generates self-cleaning heat in the appliance oven for example and so that the heater 54 is no longer energized, the interposer member tip 62.3 remains in the plane 29 of lock movement to prevent movement of the lock to its unlatching position until the selected zone of the appliance cools to a safe temperature and permits the thermostat metal disc 58 in that zone to cool to its reset temperature to move with snap action back to its reset temperature to move with snap action back to its original dished configuration. The interposer member tip is then moved out of the plane 29 permitting opening of the appliance door.

It should be understood that although particular embodiment of the invention have been described by way of illustrating the invention, the invention includes all modifications and equivalents of the disclosed embodiments falling within the scope of the appended claims.

I claim:

1. An interlock arrangement for an appliance door comprising a support, a bolt pivotally mounted on the support for movement between a latching position securing an appliance door closed and an unlatching position permitting opening of the door, a lever pivotally mounted on the support for manual movement between latching and unlatching positions thereof to move the bolt between corresponding positions, the lever having a cam and having a radial slot circumferentially disposed thereon for movement with the lever between said latching and unlatching positions of the lever, a lock pivotally mounted on the support for movement in a plane between latching and unlatching positions of the lock, the lock having a detent to be received in lever slot and having a follower to be engaged by the lever cam to pivot the lock from its unlatching position to its latching position to move the detent into the lever slot when the lever is moved to its latching position so that the detent locks the lever in its latching position when the lock is in its latching position, and an interlocking unit mounted on the support, the unit having a member normally disposed under the plane of lock movement normally permitting the lock to move between its latching and unlatching positions, having first movable and complementary electrical contacts engageable for operating an appliance, having an electrical resistance heater connectable in an appliance circuit to be selectively energized when appliance operation is to be initiated, and having means thermally responsive to the heater and to a temperature in a selected appliance zone to move the member into said plane only when the lock is in its latching position in the plane, to intercept and prevent movement of the lock in the plane from its latching position to its unlatching position, and to engage the first contacts to operate the appliance only when the lock is in its latching position, said means being thermally responsive to release the lock to move form its latching position to its unlatching position only after the heater is deenergized when appliance operation is discontinued and after the selected appliance zone is cooled so that the thermally responsive means has cooled to a predetermined reset temperature.

2. An interlock arrangement according to claim 1 wherein the lock is arranged to intercept and prevent movement of said member into the plane of lock movement when the lock is out of the latching position of the lock.

3. Interlock arrangement according to claim 2 wherein manual movement of the lever at selected angular velocity, pivots the bolt at relatively greater angular velocity, the lock is pivotally movable between its latching and unlatching positions in said plane around an axis which is tangentially disposed relative to the lever slot when the lever is in its latching position so that a force applied to the lever tending to move the lever out of its latching position initially applies less than a selected limited pivoting force to the lock at the location of the lever slot so that the member easily prevents movement of the lock to its unlatching position, and the thermally responsive means includes a snap-acting thermostat metal element disposed in heat-transfer relation to the heater and a metal strip having one end secured relative to the support and having an opposite end movable to provide said movement of the member into and out of the plane, the thermostat metal element being movable between original and inverted dished configurations with snap action at selected operating and reset temperatures to move the metal strip for providing said member movement when element temperatures in the appliance zone are at selected levels.

4. An interlock arrangement according to claim 3 wherein the interlock unit includes additional movable and complementary electrical contacts engageable to operate at least a selected appliance component for providing redundant regulation of the operation of that component and an operator is movable for engaging the additional contacts to selectively operate said component, the operator being arranged to be engaged and moved by the lock during movement of the lock to its latching position for selectively engaging the additional contacts only then the lock is in its latching position.

5. An interlock arrangement according to claim 4 wherein the support comprises a plate having the lock pivotally mounted thereon for movement in said plane parallel to the plate, and the interlock unit is mounted on the support to normally dispose said member under the plane and to normally dispose said operator adjacent an edge of the plane.

6. An interlock arrangement according to claim 5 wherein the interlock unit comprises a base, the heater includes a body of electrical resistance material of positive temperature coefficient of resistivity adapted to self-regulate to stabilize at a safe heating temperature, the thermally responsive element is mounted on the base, the metal strip has one end disposed in electrically conductive relation to the heater to extend over the heater along a length of the base, said member is slidably mounted on the base to be movable by an opposite end of the strip, the first movable contact is carried by the strip and the first complementary contact is mounted on the base to extend over the strip to be engaged by the first movable contact when the member is disposed in said plane, the additional movable and electrical contacts are mounted on the base adjacent one side of the strip and the operator is slidably mounted on the base to extend from the unit at an opposite side of the strip to be movable beneath the strip for selectively engaging the additional contacts in response to said lock movement in said plane.

7. A compact interlock unit comprising a base, a heater including a body of electrical resistance material of positive temperature coefficient of resistivity mounted on the base to be selectively energized, the heater being adapted to self-regulate to stabilize at a safe heating temperature, a thermally responsive thermostat metal element mounted on the base in heat-transfer relation to the heater to be movable with snap action between original and inverted dished configurations at selected operating and reset temperatures, a metal strip having one end disposed in electrically conductive relation to the heater to extend over the heater along a length of the base to be movable in response to snap acting movement of the thermostat metal element for moving an opposite end of the strip in response to said temperature change, a member slidably mounted on the base to be moved into and out of a plane in response to movement of the metal strip, a first movable electrical contact carried on the strip, a first complementary electrical contact mounted on the base to extend over and be engaged by the first movable contact only when the strip has moved said member into the plane, additional movable and complementary electrical contacts mounted on the base at one side of the strip to be selectively engaged, and an operator slidably mounted on the base to extend from the unit at an opposite side of the strip and to be movable beneath the strip for selectively engaging the additional contacts, whereby the member and operator are each adapted to be operatively associated with a lock movable in the plane for providing multiple interlock functions in response to lock movement.

* * * * *